US012588742B1

(12) United States Patent
Zhang

(10) Patent No.: US 12,588,742 B1
(45) Date of Patent: Mar. 31, 2026

(54) CARD HOLDER WALLET

(71) Applicant: Mingchun Zhang, Hunan Province (CN)

(72) Inventor: Mingchun Zhang, Hunan Province (CN)

( * ) Notice: Subject to any disclaimer, the term of this patent is extended or adjusted under 35 U.S.C. 154(b) by 0 days.

(21) Appl. No.: 19/077,494

(22) Filed: Mar. 12, 2025

(51) Int. Cl.
*A45C 11/18* (2006.01)

(52) U.S. Cl.
CPC ..... *A45C 11/182* (2013.01)

(58) Field of Classification Search
CPC ..... A45C 11/182
USPC ..... 150/149
See application file for complete search history.

(56) References Cited

U.S. PATENT DOCUMENTS

| | | | | | |
|---|---|---|---|---|---|
| 1,537,244 | A * | 5/1925 | Mccaghren | A45C 11/18 | 206/39.3 |
| 1,670,343 | A * | 5/1928 | Clemens | A45C 11/18 | 206/39 |
| 2,839,114 | A * | 6/1958 | Moscowitz | G03B 17/26 | 150/144 |
| 3,710,929 | A * | 1/1973 | Morales | A45C 11/18 | 206/39.5 |
| 3,970,129 | A * | 7/1976 | Tepfer | A45C 11/18 | 150/900 |
| 5,718,329 | A * | 2/1998 | Ippolito | A45C 11/182 | 150/147 |
| 11,246,388 | B2 * | 2/2022 | Mayer | A45C 11/182 | |
| 11,969,066 | B1 * | 4/2024 | Zeng | A45C 1/06 | |
| 2013/0276943 | A1 * | 10/2013 | Minn | A45C 1/06 | 150/137 |
| 2014/0060712 | A1 * | 3/2014 | Beckley | A45C 1/06 | 150/133 |
| 2015/0083289 | A1 * | 3/2015 | Johnson | A45C 1/06 | 150/144 |
| 2018/0235338 | A1 * | 8/2018 | Lamb | A45C 1/06 | |
| 2019/0215388 | A1 * | 7/2019 | Cantoli-Alves | A45C 11/00 | |
| 2019/0269213 | A1 * | 9/2019 | Deng | A45C 11/18 | |
| 2022/0400823 | A1 * | 12/2022 | Clarete | A45C 1/06 | |
| 2024/0315413 | A1 * | 9/2024 | Wu | A45C 11/182 | |
| 2024/0341430 | A1 * | 10/2024 | Lin | A45C 11/182 | |
| 2024/0415253 | A1 * | 12/2024 | Zhang | A45C 11/182 | |

FOREIGN PATENT DOCUMENTS

| | | | | |
|---|---|---|---|---|
| CA | 2881061 | A1 * | 10/2012 | A45C 1/06 |
| WO | WO-2007018874 | A1 * | 2/2007 | B32B 27/304 |

* cited by examiner

*Primary Examiner* — Nathan J Jenness
*Assistant Examiner* — Justin Caudill

(57) ABSTRACT

A card holder wallet is provided, including a first panel, a second panel, a first elastic band, a second elastic band, and a flexible band. Two ends of the first elastic band are respectively fixed at a position of the first panel close to one side and a position of the second panel close to one side; two ends of the second elastic band are respectively fixed at a position of the first panel close to another side and a position of the second panel close to another side; and two ends of the flexible band are respectively fixed at a bottom of the first panel and a bottom of the second panel. The first panel, the second panel, the first elastic band, the second elastic band, and the flexible band form the card holder wallet provided with the opening in one side and having the accommodating cavity.

6 Claims, 6 Drawing Sheets

CARD HOLDER WALLET

TECHNICAL FIELD

The present invention relates to the technical field of articles of daily use, in particular, to a card holder wallet.

BACKGROUND

As is well known, a card holder wallet is a daily article for storing credit cards, bank cards, postcards, business cards, and other cards. The card holder wallet is generally composed of a first clamping plate, a second clamping plate, and an elastic band, and both the first clamping plate and the second clamping plate are made of rigid materials, so that the entire card holder wallet is heavy. In addition, in order to fix the elastic band, a storage space needs to be provided inside both the first clamping plate and the second clamping plate, and a structure for fixing the elastic band needs to be configured on the storage space. Therefore, the first clamping plate and the second clamping plate are easily made to be thick, and thicknesses of the first clamping plate and the second clamping plates are at least greater than 1.5 mm, which increases the heaviness of the product and makes the entire product not lightweight enough. This affects the user experience. Furthermore, the existing card holder wallet for storing cards, coins, and the like is generally formed by connecting two leather panels. There are limitations on thicknesses of cards and coins that are stored in the card holder wallet, so that the card holder wallet cannot adaptively store the coins and the cards according to thicknesses of the coins and a quantity of the cards.

SUMMARY

The present invention mainly aims to provide a card holder wallet, to solve the problems that an existing card holder wallet is heavy and not portable because of it is made of a rigid material and the card holder wallet cannot adaptively store coins and cards according to thicknesses of the coins and a quantity of the cards.

In order to solve the technical problem, the technical scheme provided by the present invention is as follows.

A card holder wallet includes a first panel, a second panel, a first elastic band, a second elastic band and a flexible band.

The second panel is opposite to the first panel.

One end of the first elastic band is fixed to a position of the first panel close to one side, and another end of the first elastic band is fixed to a position of the second panel close to one side.

One end of the second elastic band is fixed to a position of the first panel close to another side, and another end of the second elastic band is fixed to a position of the second panel close to another side.

One end of the flexible band is fixed at a bottom of the first panel or close to the bottom of the first panel, and another end of the flexible band is fixed at a bottom of the second panel or close to the bottom of the second panel.

The first panel and the second panel are both flexible; the first panel and the second panel are at least partially made of flexible materials; and the first panel, the second panel, the first elastic band, the second elastic band, and the flexible band form the card holder wallet provided with an opening in one side and having an accommodating cavity.

Furthermore, the card holder wallet further includes a spring piece with one end arranged on the first panel or the second panel; the spring piece is at least partially placed in the accommodating cavity; and a distance between the spring piece and an inner wall of the accommodating cavity gradually decreases in a direction away from the opening.

Furthermore, the spring piece is arranged at one of a center position of the first panel, a position of the first panel close to a center, a center position of the second panel, or a position of the second panel close to a center.

Furthermore, a width of the spring piece gradually decreases in the direction away from the opening.

Furthermore, the card holder wallet further includes a flip cover connected to the first panel, the flip cover is made of a flexible material; and a free end of the flip cover is configured to be detachably fixed on the second panel to cover at least a portion of the opening.

Furthermore, the flip cover is provided with a first magnetic member; the second panel is provided with a second magnetic member that attracts the first magnetic member; and when the free end of the flip cover is fixed to the second panel, the first magnetic member attracts the second magnetic member.

Furthermore, the flip cover is formed by extending outward from the first panel.

Furthermore, the opening convenient to push a card out is provided in the bottom of the first panel and/or the second panel, and the opening is communicated to the accommodating cavity.

Furthermore, the opening is located in a middle position of the bottom of the first panel.

Furthermore, two flexible bands are included, which are respectively located on two sides of the opening, and the flexible bands are clastic bands.

Furthermore, two ends of the first elastic band, two ends of the second clastic band, and two ends of the flexible band are sewn onto the first panel and the second panel respectively by using sewing threads.

Furthermore, the first panel includes: a first panel body, a second panel body connected to the first panel body, and a third panel body arranged between the first panel body and the second panel body; the first panel body and the second panel body are both made of flexible materials; the third panel body has flexibility; the third panel body is sheet-like; the second panel body is located on one side of the first panel body close to the accommodating cavity;

one end of the first elastic band, one end of the second elastic band, and one end of the flexible band are all fixed to the first panel body and/or the second panel body; and another end of the first elastic band, another end of the second elastic band, and another end of the flexible band are fixed to the second panel.

Furthermore, the first panel body is fixed to the second panel body through a sewing thread in a sewn manner and/or fixed to the second panel in a bonded manner at a peripheral side of the third panel body.

Furthermore, the first panel body includes a first buffer layer and a first flexible layer bonded to the first buffer layer; the second panel body includes a second buffer layer and a second flexible layer bonded to the second buffer layer; the third panel body is located between the first buffer layer and the second buffer layer; the first flexible layer is made of one of leather, a flexible glue material, and a cloth material; the second flexible layer is made of one of leather, a flexible glue material, and a cloth material; the first buffer layer and the second buffer layer are both made of one of paper, foam, and sponge; a thickness of the third panel body is 0.15 mm to 1 mm; the third panel body is made of one of plastic, metal, and a carbon fiber material.

Furthermore, the third panel body is provided with a dividing gap and forms the spring piece through the dividing gap; the spring piece passes through the second panel body and is then placed in the accommodating cavity; and a distance between the spring piece and the second panel body gradually decreases in the direction away from the opening.

Furthermore, the second panel includes: a fourth panel body, a fifth panel body connected to the fourth panel body, and a sixth panel body arranged between the fourth panel body and the sixth panel body; the fourth panel body and the fifth panel body are both made of flexible materials; the sixth panel body has flexibility; the sixth panel body is sheet-like; the fifth panel body is located on one side of the fourth panel body close to the accommodating cavity; and another end of the first elastic band, another end of the second elastic band, and another end of the flexible band are fixed to the fourth panel and/or the fifth panel.

Furthermore, the fourth panel body is fixed to the fifth panel body through a sewing thread in a sewn manner and/or fixed to the fifth panel in a bonded manner at a peripheral side of the sixth panel body.

Furthermore, the fourth panel body includes a third buffer layer and a third flexible layer bonded to the third buffer layer; the fifth panel body includes a fourth buffer layer and a fourth flexible layer bonded to the fourth buffer layer; the sixth panel body is located between the third buffer layer and the fourth buffer layer; the third flexible layer is made of one of leather, a flexible glue material, and a cloth material; the fourth flexible layer is made of one of leather, a flexible glue material, and a cloth material; the third buffer layer and the fourth buffer layer are both made of one of paper, foam, and sponge; a thickness of the sixth panel body is 0.15 mm to 1 mm; and the sixth panel body is made of one of plastic, metal, and a carbon fiber material.

Furthermore, one end of the first elastic band, one end of the second elastic band, and one end of the flexible band are all arranged between the first panel body and the second panel body, and another end of the first elastic band, another end of the second clastic band, and another end of the flexible band are located on one side of the fifth panel body away from the second panel body; one end of the first elastic band, one end of the second elastic band, and one end of the flexible band are sewn together with the first panel body and the second panel body through sewing threads; and another end of the first elastic band, another end of the second clastic band, and another end of the flexible band are sewn together with the fourth panel body and the fifth panel body through sewing threads.

Furthermore, a first paint edge is arranged at a peripheral side of the first panel; the first paint edge at least covers a gap between the first panel body and the second panel body; a second paint edge is arranged at a peripheral side of the second panel; and the second paint edge at least covers a gap between the first fourth body and the fifth panel body.

Beneficial effects of the present invention are as follows. Compared with the prior art, In this invention, the first panel, the second panel, the first elastic band, the second clastic band, and the flexible band form the card holder wallet provided with the opening in one side and having the accommodating cavity, so that cards can be placed into the accommodating cavity through the opening or can be taken out of the accommodating cavity, to achieve card storage and limitation. The first panel and the second panel are at least partially made of the flexible materials, which can effectively reduce weights of the first panel and the second panel, to reduce a mass of the card holder wallet, and facilitate carrying. Both the first panel and the second panel have flexibility, so that the first panel and the second panel can deform from the opening and enlarge the opening, to store a card into the accommodating cavity from the opening, making it convenient for use.

BRIEF DESCRIPTION OF THE DRAWINGS

In order to explain the technical solutions of the embodiments of the present invention more clearly, the following will briefly introduce the accompanying drawings used in the embodiments. Apparently, the drawings in the following description are only some embodiments of the present invention. Those of ordinary skill in the art can obtain other drawings based on these drawings without creative work.

DETAILED DESCRIPTION OF THE EMBODIMENTS

Figure 1:
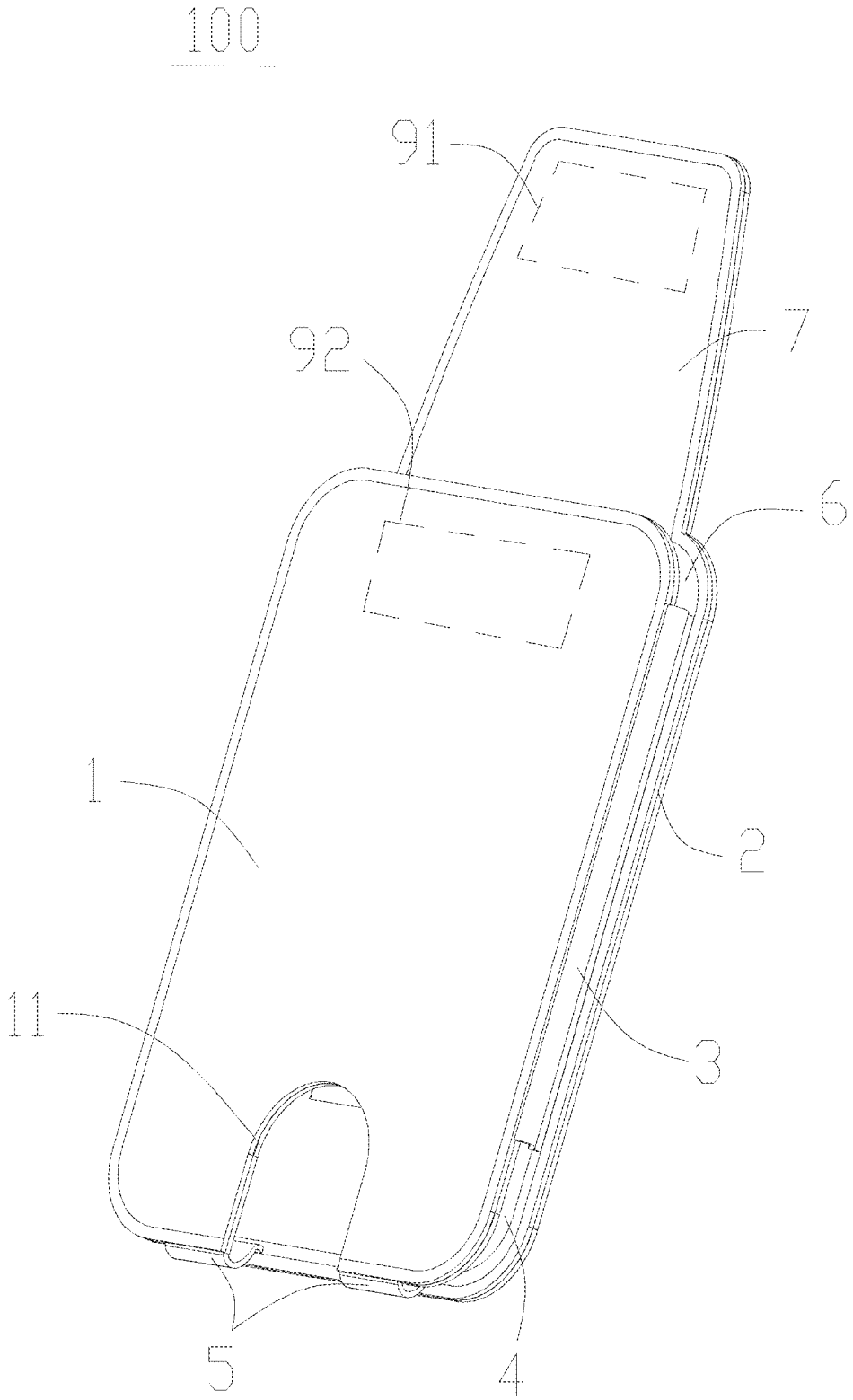
FIG. 1 is a schematic state diagram of a card holder wallet with a flip cover being opened according to the present invention.

The technical solutions in the embodiments of the present invention will be clearly and completely described below in conjunction with the accompanying drawings in the embodiments of the present invention. Apparently, the described embodiments are only a part of the embodiments of the present invention, rather than all the embodiments. Based on the embodiments in the present invention, all other embodiments obtained by those ordinarily skilled in the art without doing creative work shall fall within the protection scope of the present invention.

Referring to FIG. 1 to FIG. 6, a card holder wallet 100 in an embodiment of the present invention is configured to store cards.

The card holder wallet 100 includes a first panel 1, a second panel 2, a first elastic band 3, a second elastic band 8, and a flexible band 5. The second panel 2 and the first panel 1 are opposite to each other. One end of the first elastic band 3 is fixed to a position of the first panel 1 close to one side, and another end of the first elastic band 3 is fixed to a position of the second panel 2 close to one side. One end of the second elastic band 8 is fixed to a position of the first panel 1 close to another side, and another end of the second elastic band 8 is fixed to a position of the second panel 2 close to another side. One end of the flexible band 5 is fixed at a bottom of the first panel 1 or close to the bottom of the first panel 1, and another end of the flexible band 5 is fixed at a bottom of the second panel 2 or close to the bottom of the second panel 2. The first panel 1 and the second panel 2 are both flexible. The first panel 1 and the second panel 2 are at least partially made of flexible materials. The first panel 1, the second panel 2, the first elastic band 3, the second elastic band 8, and the flexible band 5 form the card holder wallet 100 provided with an opening 11 in one side and having an accommodating cavity 6.

In this embodiment, the first panel 1, the second panel 2, the first elastic band 3, the second elastic band 8, and the flexible band 5 form the card holder wallet 100 provided with the opening 11 in one side and having the accommodating cavity 6, so that cards can be placed into the accommodating cavity 6 through the opening 11 or can be taken out of the accommodating cavity 6, to achieve card storage and limitation. The first panel 1 and the second panel 2 are at least partially made of the flexible materials, which can effectively reduce weights of the first panel 1 and the second panel 2, to reduce a mass of the card holder wallet 100, and facilitate carrying. Both the first panel 1 and the second panel 2 have flexibility, so that the first panel 1 and the second panel 2 can deform from the opening 11 and enlarge the opening 11, to store a card into the accommodating cavity 6 from the opening 11, making it convenient for use. In addition, according to a characteristic that the first elastic band 3, the second elastic band 8, and the flexible band 5 can be stretched and reset, a thickness of the accommodating cavity 6 can be adaptively adjusted for storage according to a quantity of cards stored and/or a thickness of coins stored, in order to achieve such an effect that this card holder wallet is light and thin during adaptive storage of different quantities of cards. This facilitates carrying.

Specifically, the first panel 1 and the second panel 2 can be completely made of the flexible materials, or the first panel 1 and the second panel 2 can be partially made of the flexible materials and a plastic sheet, a metal sheet, a carbon fiber sheet, or the like, to achieve the flexibility of the first panel 1 and the second panel 2. There can be one, two, or more first elastic bands, one, two, or more second elastic bands, and one, two, or more flexible bands. The flexible band is made of a flexible material, which means that the flexible band can be an elastic band, or a flexible rubber material or cloth that can be bent, folded, or deformed.

In an embodiment, the card holder wallet 100 further includes a spring piece 10 with one end arranged on the first panel 1 or the second panel 2. The spring piece 10 is at least partially placed in the accommodating cavity 6. When one end of the spring piece 10 is arranged on the first panel 1, a distance between the spring piece 10 and the second panel 2 gradually decreases in a direction away from the opening 11. That is, there is a tilting spring piece 10 in the accommodating cavity 6. When a card is stored into the accommodating cavity 6, the second panel 2 and the spring piece 10 can cooperate with each other to compress the card, to prevent the card from falling off from the opening 11 and further play a role of limiting the card.

When one end of the spring piece 10 is arranged on the second panel 2, a distance between the spring piece 10 and the first panel 1 gradually decreases in the direction away from the opening 11. When a card is stored into the accommodating cavity 6, the second panel 1 and the spring piece 10 can cooperate with each other to compress the card.

Certainly, in other embodiments, the spring piece 10 may not be configured. The first elastic band 3 and the second elastic band 8 themselves have elasticity and stretchability. When a card is placed in the accommodating cavity 6, the card can also be limited. In order to increase friction between the first panel 1, the second panel 2, the first elastic band 3, as well as the second elastic band 8, and the card, rubber layers, damping layers, or the like are can be arranged on sides of the first panel 1, the second panel 2, the first elastic band 3, and the second elastic band 8 close to the accommodating cavity 6.

In the embodiment where one end of the spring piece 10 is arranged on the first panel 1, the spring piece 10 is arranged at a center position of the first panel 1 or at a position close to a center of the first panel 1, so that when a card is stored in the accommodating cavity 6, the spring piece 10 can compress the card from the center position or the position close to the center, to effectively limit the card. Certainly, in other embodiments, the spring piece 10 can also be arranged at a position of the first panel 1 close to the opening 11, a position of the first panel 1 close to the bottom, a position of the first panel 1 close to the first elastic band 3, a position of the first panel 1 close to the second elastic band 8, and the like.

In the embodiment where one end of the spring piece 10 is arranged on the second panel 2, the spring piece 10 can be arranged at the center position of the second panel 2, the position close to the center, a position close to the opening 11, a position close to the first elastic band 3, a position close to the second elastic band 8, and the like.

In an embodiment, a width of the spring piece 10 gradually decreases in the direction away from the opening 11, to maintain an optimal elasticity of the spring piece 10 and better compress a card. When a card is inserted into the accommodating cavity 6, a contact area between the card and the spring piece 10 can be reduced, which facilitates card storage. Certainly, in other embodiments, the width of the spring piece 10 may remain constant or gradually increase in the direction away from the opening 11, or may vary irregularly.

Figure 2:
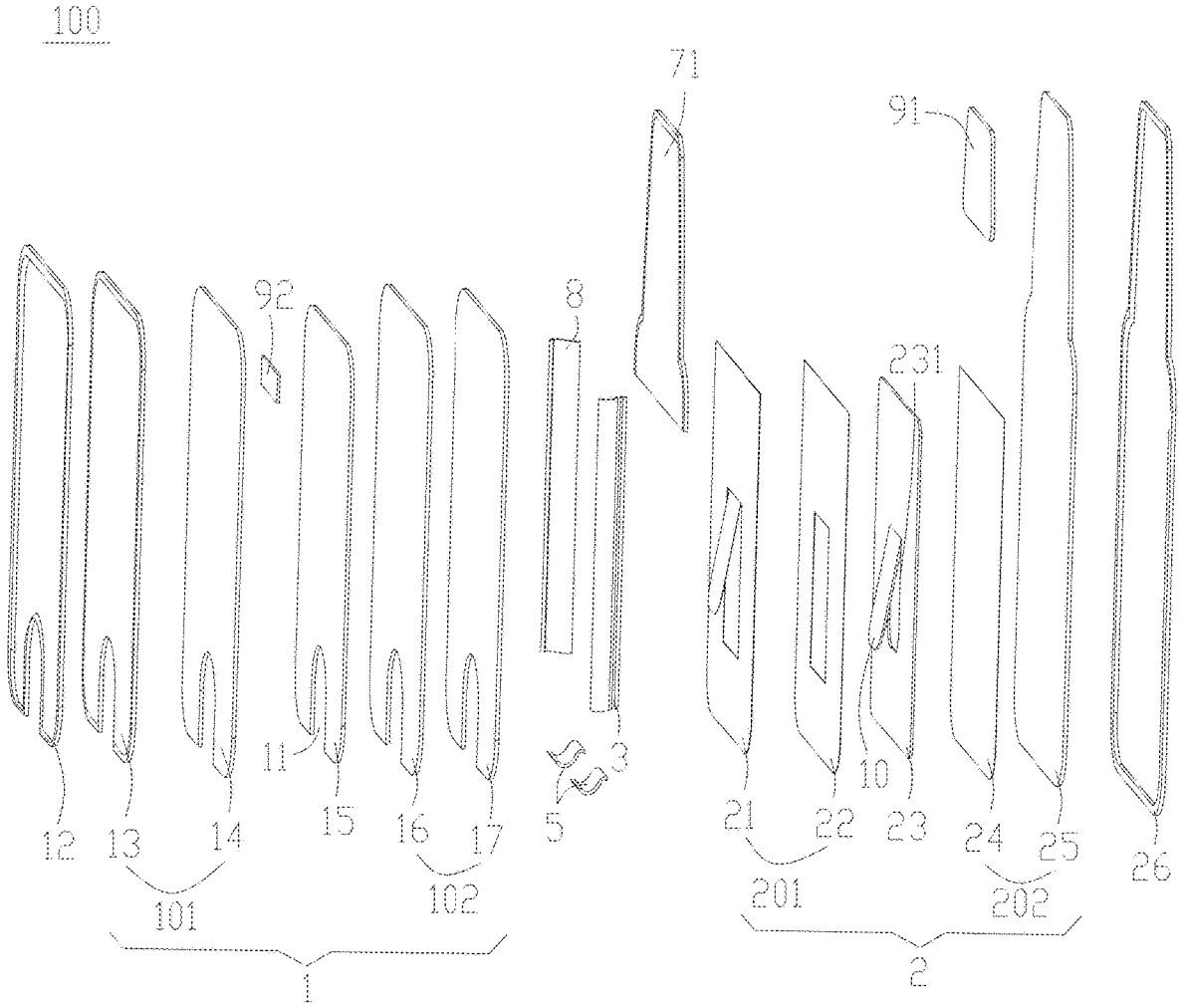
FIG. 2 is an exploded view of a card holder wallet with a flip cover according to the present invention.
Figure 3:
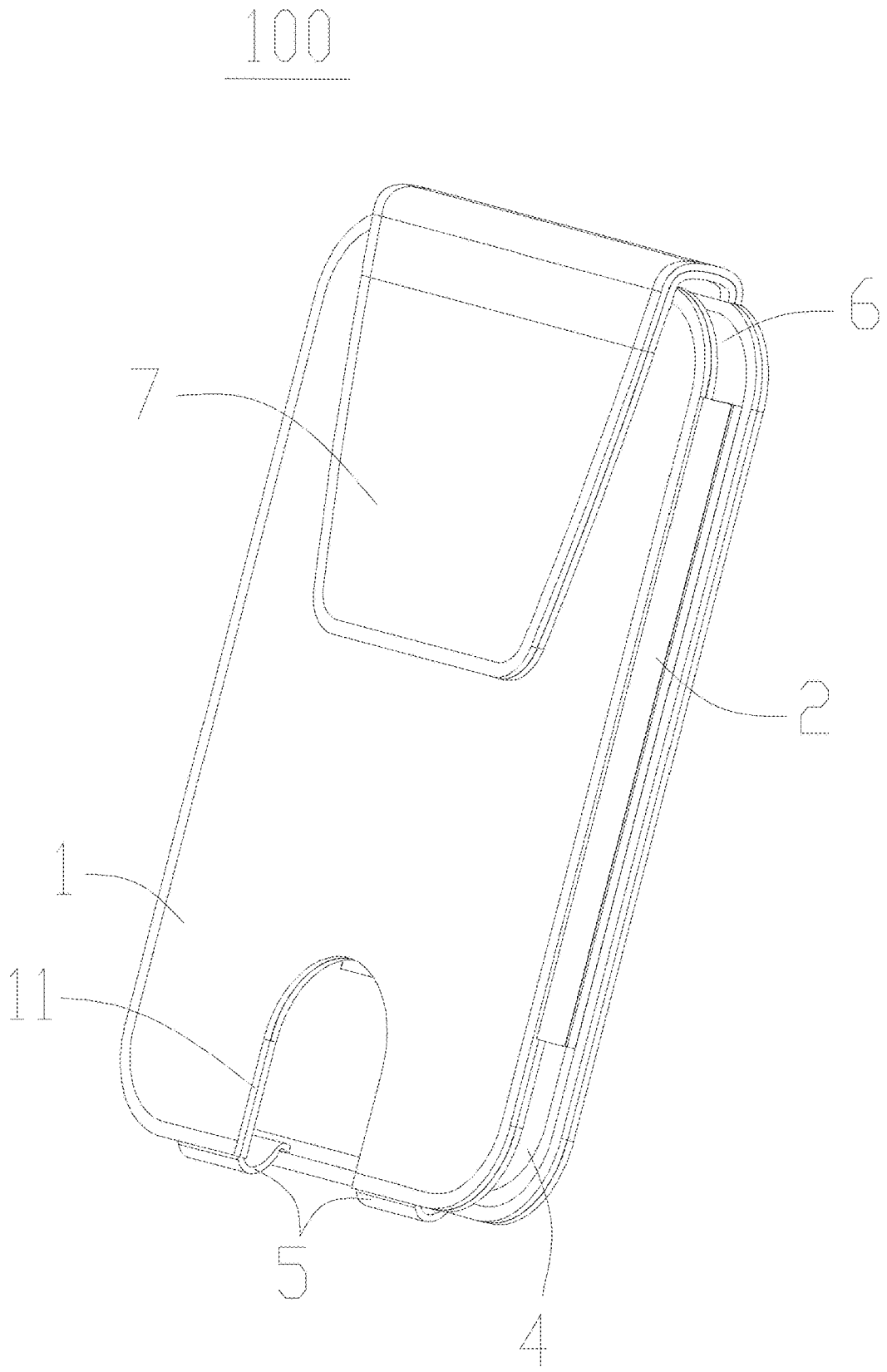
FIG. 3 is a schematic state diagram of a card holder wallet with a flip cover being closed according to the present invention.

In an embodiment, the card holder wallet 100 further includes a flip cover 7 connected to the first panel 1. As shown in FIG. 1 to FIG. 3, the flip cover 7 is made of a flexible material. A free end of the flip cover 7 is configured to be detachably fixed on the second panel 2 to cover at least a portion of the opening 11. The flip cover 7 can effectively prevent a card from falling off from the opening 11 when the card is stored into the card holder wallet 100.

In an embodiment, the flip cover 7 is provided with a first magnetic member 91. The second panel 2 is provided with a second magnetic member that attracts the first magnetic member 91. When the free end of the flip cover 7 is fixed to the second panel 2, the first magnetic member 91 attracts the second magnetic member 92, to achieve the detachable connection between the free end of the flip cover 7 and the second panel 2. Certainly, in other embodiments, the free end of the flip cover 7 can also be detachably connected to the second panel 2 through a hook and loop fastener, a button, a hasp, a buckle, and the like.

In an embodiment, the flip cover 7 is formed by extending outward from the first panel 1, namely, the flip cover 7 and the first panel 1 are of an integrated structure for ease of production and manufacturing of the product.

Figure 4:
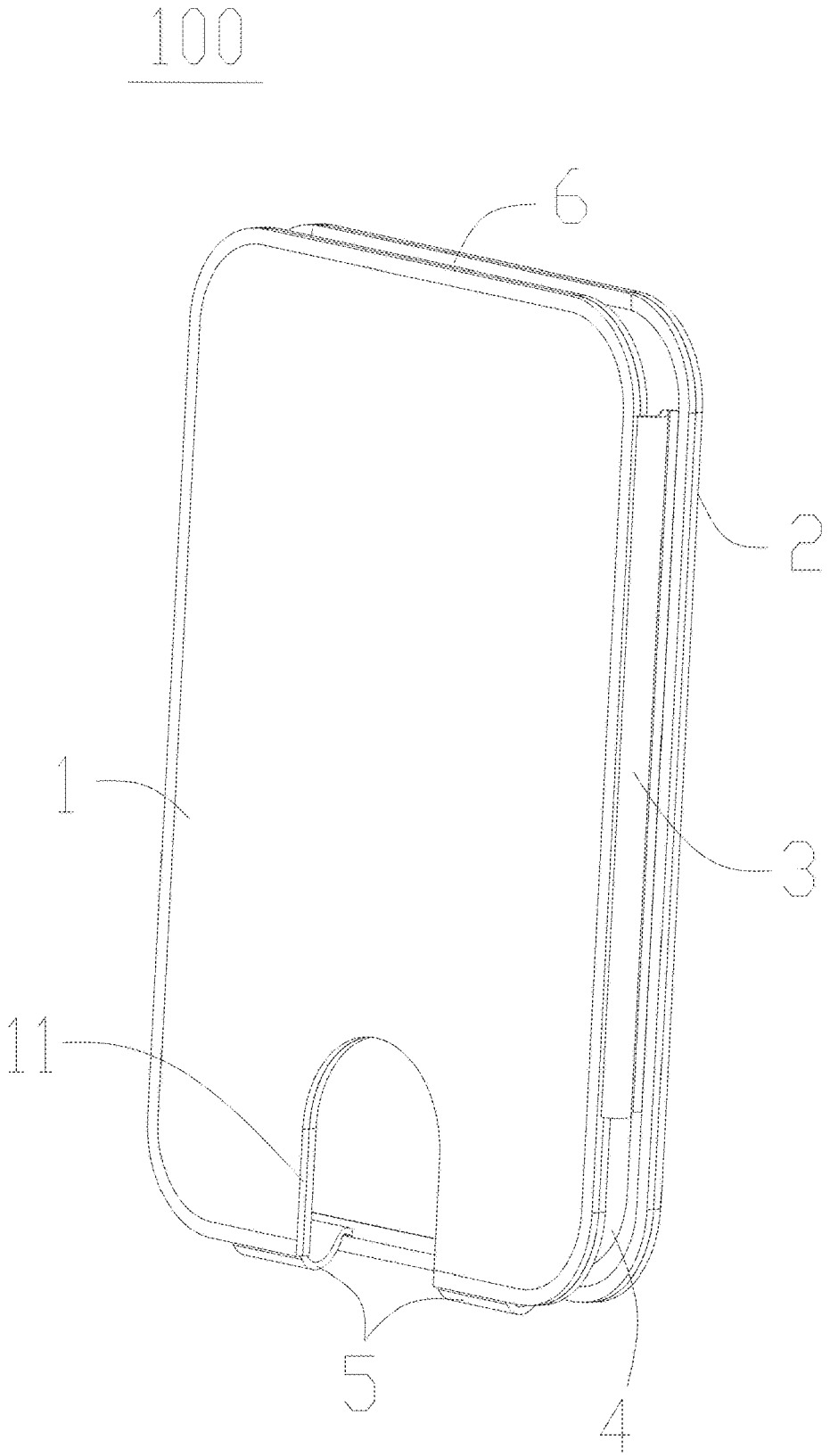
FIG. 4 is a schematic diagram of a card holder wallet without a flip cover according to the present invention.
Figure 5:
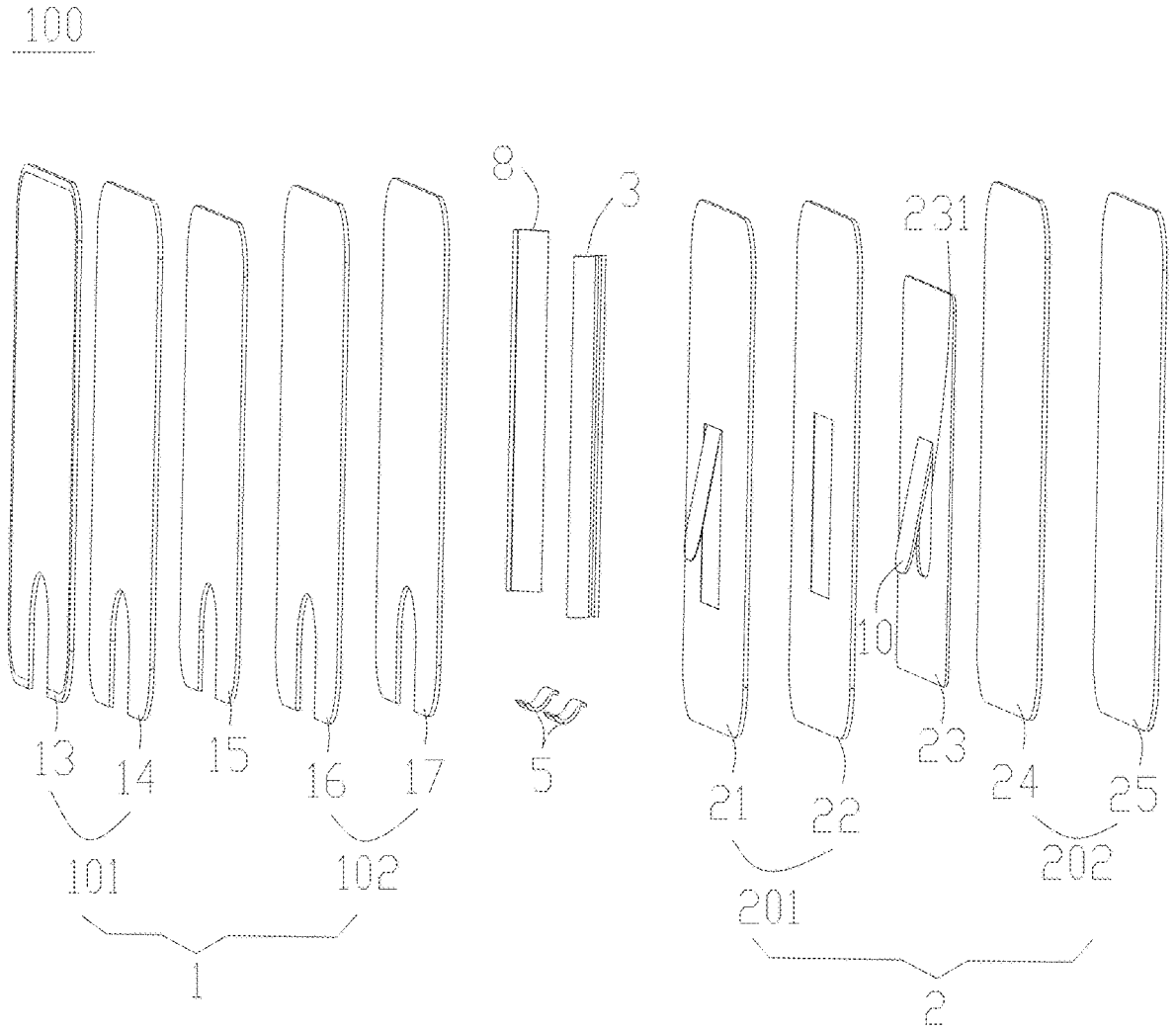
FIG. 5 is an exploded view of a card holder wallet without a flip cover according to the present invention.
Figure 6:
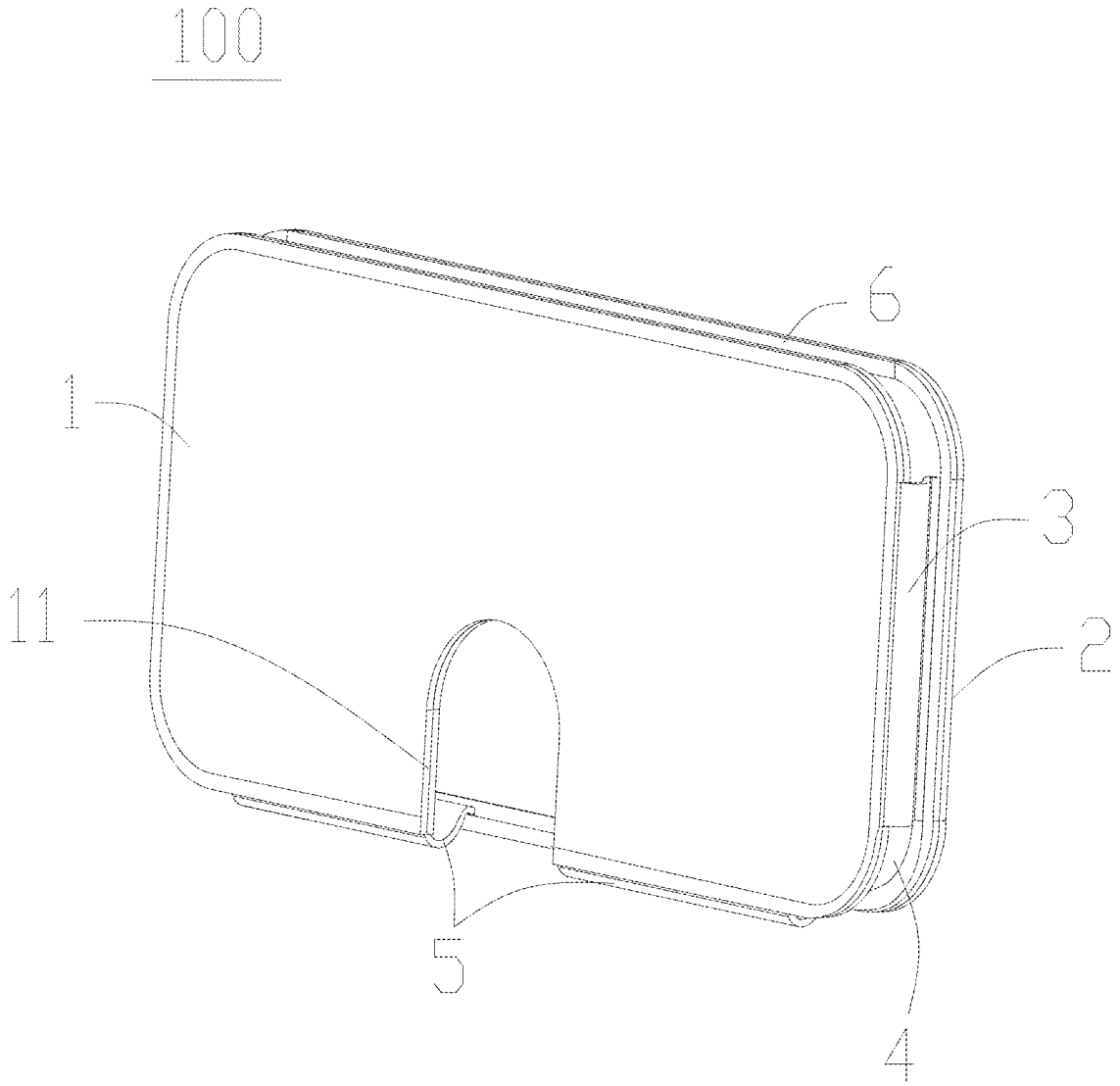
FIG. 6 is a schematic diagram of a card holder wallet that transversely stores a card according to the present invention.

In other embodiments, the flip cover 7 can also be connected to the second panel 2, and the free end of the flip cover 7 is detachably connected to the first panel 1, which can also cover at least a portion of the opening 11. In addition, in other embodiments, the card holder wallet 100 may not include the flip cover 7, as shown in FIG. 4 to FIG. 6.

In an embodiment, the opening 11 convenient for a user to push a card out is provided in the bottom of the first panel 1 and/or the second panel 2, and the opening 11 is communicated to the accommodating cavity 6, so that it is convenient for the user to take out the card.

In an embodiment, the opening 11 is located in a middle position of the bottom of the first panel 1. Namely, by using the opening 11 at this position, a card can be pushed from a middle position of a bottom of the card, which achieves effective pushing on the card. Certainly, in other embodiments, the opening 11 can also be located at a position, far away from the middle, of the bottom of the second panel 1.

In an embodiment, there are two flexible bands 5 which are respectively located on two sides of the opening 11, to effectively support and limit a bottom of a card.

In an embodiment, two ends of the first elastic band 3, two ends of the second elastic band 8, and two ends of the flexible band 5 are sewn onto the first panel 1 and the second panel 2 respectively using sewing threads, to stably fix the first elastic band 3, the second elastic band 8, and the flexible band 5. In other embodiments, the two ends of the first elastic band 3, two ends of the second elastic band 8, and two ends of the flexible band 5 can also be fixed in a bonded manner.

In an embodiment, the first panel 1 includes: a first panel body 101, a second panel body 102 connected to the first panel body 101, and a third panel body 15 arranged between the first panel body 101 and the second panel body 102. The first panel body 101 and the second panel body 102 are both made of flexible materials. The third panel body 15 has flexibility. The third panel body 15 is sheet-like. The second panel body 102 is located on one side of the first panel body 101 close to the accommodating cavity 6. One end of the first elastic band 3, one end of the second elastic band 8, and one end of the flexible band 5 are fixed to the first panel body 101 and/or the second panel body 102, and another end of the first elastic band 3, another end of the second elastic band 8, and another end of the flexible band 5 are fixed to the second panel 2. By using the third panel body 15, hardness of the first panel 1 can be increased, so that the accommodating cavity 6 formed can limit a card.

In an embodiment, the first panel body 101 is fixed to the second panel body 102 on a peripheral side of the third panel body 15 through a sewing thread, to wrap the third panel body 15 inside and provide a softer hand feel for an outer side surface of the first panel 1. Certainly, a surface of the first panel body 101 that abuts against the third panel body 15 and a surface of the second panel body 102 that abuts against the third panel body 15 can be fixed in a bonded manner, to make the structure of the first panel 1 more compact.

In an embodiment, the first panel body 101 is fixed to the second panel body 102 on a peripheral side of the third panel body 15 in a bonded manner, to wrap the third panel body 15 inside. In addition, the first panel body 101 and the second panel body 102 are sewn through a sewing thread, which can make the structure of the first panel 1 more compact.

In an embodiment, the first panel body 101 includes a first buffer layer 14 and a first flexible layer 13 bonded to the first buffer layer 14. The second panel body 102 includes a second buffer layer 16 and a second flexible layer 17 bonded to the second buffer layer 16. The third panel body 15 is located between the first buffer layer 14 and the second buffer layer 16. The first flexible layer 13 can be made of leather, a flexible glue material, a cloth material, and the like. The second flexible layer 17 can be made of leather, a flexible glue material, a cloth material, and the like. A thickness of the third panel body 15 is 0.15 mm to 1 mm. The third panel body 15 can be made of plastic, metal, a carbon fiber material, and the like. The first buffer layer 14 and the second buffer layer 16 can be made of paper, foam, sponge, and the like, to make the first panel 1 light and thin. In addition, through the first buffer layer 14, the second buffer layer 16, the first flexible layer 13, and the second flexible layer 17, the hand feel on the first panel 1 can be soft, and the first panel 1 can also have hardness, to limit a card.

Certainly, in other embodiments, the first panel body 101 and the second panel body 102 can be directly made of leather, a soft rubber material, a cloth material, and the like, without configuring the first buffer layer 14 and the second buffer layer 16. In addition, in the embodiment of including the flip cover 7, the flip cover 7 can be formed by extending from the first flexible layer 13, or the flip cover 7 can be formed by extending from the first flexible layer 13 and another flexible layer 71 and then being sewn.

In the embodiment of including the elastic piece 10, the third panel body 15 is provided with a dividing gap and forms the spring piece 10 through the dividing gap. The spring piece 10 passes through the second panel body 102 and is then placed in the accommodating cavity 6. A distance between the spring piece 10 and the second panel body 2 gradually decreases in the direction away from the opening 11. Through this structure, it is easy to configure the spring piece 10, and one end of the spring piece 10 close to the opening 11 will not protrude out of an inner side surface of the accommodating cavity 6. One end of the spring piece 10 away from the opening 11 is arranged in the accommodating cavity 6, so that when a card is inserted into the accommodating cavity 6 from the opening 11, the spring piece 10 cannot hinder the storage of the card, thereby enhancing the use experience of the card holder wallet 100.

In an embodiment, the second panel 2 includes: a fourth panel body 202, a fifth panel body 201 connected to the fourth panel body 202, and a sixth panel body 23 arranged between the fourth panel body 202 and the fifth panel body 201. The fourth panel body 202 and the fifth panel body 201 are both made of flexible materials. The sixth panel body 23 has flexibility. The sixth panel body 23 is sheet-like. The fifth panel body 201 is located on one side of the fourth panel body 202 close to the accommodating cavity 6. Another end of the first elastic band 3, another end of the second elastic band 8, and another end of the flexible band 5 are fixed to the fourth panel 202 and/or the fifth panel 201. By using the sixth panel body 23, hardness of the second panel 2 can be increased, so that the accommodating cavity 6 formed can limit a card.

In an embodiment, the fourth panel body 202 is fixed to the fifth panel body 201 on a peripheral side of the sixth panel body 23 through a sewing thread, to wrap the sixth panel body 23 inside and provide a softer hand feel for an outer side surface of the second panel 2. Certainly, a surface of the fourth panel 202 that abuts against the sixth panel 23 and a surface of the fifth panel 201 that abuts against the sixth panel 23 can be fixed in a bonded manner, to make the structure of the second panel 2 more compact.

In an embodiment, the fourth panel body 202 is fixed to the fifth panel body 201 on a peripheral side of the sixth panel body 23 in a bonded manner, to wrap the sixth panel body 23 inside. In addition, the fourth panel body 202 and the fifth panel body 201 are sewn through a sewing thread, which can make the structure of the second panel 2 more compact.

In an embodiment, the fourth panel body 202 includes a third buffer layer 24 and a third flexible layer 25 bonded to the third buffer layer 24. The fifth panel body 201 includes a fourth buffer layer 22 and a fourth flexible layer 21 bonded to the fourth buffer layer 22. The sixth panel body 23 is located between the third buffer layer 24 and the fourth buffer layer 22. The third flexible layer 25 can be made of leather, a flexible glue material, a cloth material, and the like.

The fourth flexible layer 21 can be made of leather, a flexible glue material, a cloth material, and the like. The third buffer layer 25 and the fourth buffer layer 21 are both made of paper, foam, sponge, and the like. A thickness of the sixth panel body 23 is 0.15 mm to 1 mm. The sixth panel body 23 can be made of plastic, metal, a carbon fiber material, and the like, making the first panel 1 thin and light. In addition, through the third buffer layer 24, the fourth buffer layer 22, the third flexible layer 25, and the fourth flexible layer 21, the hand feel on the second panel 2 can be soft, and the second panel 2 can also have hardness, to limit a card.

Certainly, in other embodiments, the fourth panel body 202 and the fifth panel body 201 can be directly made of leather, a soft rubber material, a cloth material, and the like, without configuring the third buffer layer 24 and the fourth buffer layer 22.

In an embodiment, one end of the first elastic band 3, one end of the second elastic band 8, and one end of the flexible band 5 are all arranged between the first panel body 101 and the second panel body 102, and another end of the first elastic band 3, another end of the second elastic band 8, and another end of the flexible band 5 are located on one side of the fifth panel body 201 away from the second panel body 102, namely, the first elastic band 3, the second elastic band 8, and the flexible band 5 are arranged on the first panel 1 and the second panel 2 in a Z-shaped manner. One end of the first elastic band 3, one end of the second elastic band 8, and one end of the flexible band 5 are all sewn with the first panel body 101 and the second panel 102 through sewing threads. Namely, when the first panel body 101 and the second panel body 102 are sewn by using the sewing thread, one end of the first elastic band 3, one end of the second elastic band 8, and one end of the flexible band 5 can be sewn and fixed together. Another end of the first elastic band 3, another end of the second elastic band 8, and another end of the flexible band 5 are all sewn with the fourth panel body 202 and the fifth panel body 201 through sewing threads. Namely, when the fourth panel body 202 and the fifth panel body 201 are sewn by using the sewing thread, another end of the first elastic band 3, another end of the second elastic band 8, and another end of the flexible band 5 can be sewn and fixed together, to reduce procedures of producing the card holder wallet 100.

In an embodiment, a first paint edge 12 is arranged on the peripheral side of the first panel 1. The first paint edge 12*e* at least covers a gap between the first panel body 101 and the second panel 102. A second paint edge 26 is arranged on the peripheral side of the second panel 2. The second paint edge 26 at least covers a gap between the fourth panel body 202 and the fifth panel body 201, to beautify the appearance of the card holder wallet 100.

In an embodiment, a length of the accommodating cavity 6 on a horizontal axis is less than a length of the accommodating cavity 6 on a vertical axis, so as to configure the accommodating cavity 6 to vertically store a card, as shown in FIG. 1, FIG. 3, and FIG. 4.

In an embodiment, a length of the accommodating cavity 6 on a vertical axis is less than a length of the accommodating cavity 6 on a horizontal axis, so as to configure the accommodating cavity 6 to transversely store a card, as shown in FIG. 6.

It should be noted that all directional indications (such as up, down, left, right, front, back . . . ) in the embodiments of the present invention are only used to explain a relative positional relationship between components, motion situations, etc. at a certain specific attitude (as shown in the figures). If the specific attitude changes, the directional indication also correspondingly changes.

In addition, the descriptions of "first", "second", etc. in the present invention are only used for descriptive purposes, and cannot be understood as indicating or implying its relative importance or implicitly indicating the number of technical features indicated. Therefore, features defined by "first" and "second" can explicitly instruct or impliedly include at least one feature. In addition, "and/or" in the entire text includes three solutions. A and/or B is taken as an example, including technical solution A, technical solution B, and technical solutions that both A and B satisfy. In addition, the technical solutions between the various embodiments can be combined with each other, but it needs be based on what can be achieved by those of ordinary skill in the art. When the combination of the technical solutions is contradictory or cannot be achieved, it should be considered that such a combination of the technical solutions does not exist, and is not within the scope of protection claimed by the present invention.

The above descriptions are only preferred embodiments of the present invention, and are not intended to limit the patent scope of the present invention. Any equivalent structural transformation made by using the content of the specification and the drawings of the present invention under the invention idea of the present invention, directly or indirectly applied to other related technical fields, shall all be included in the scope of patent protection of the present invention.

What is claimed is:

1. A card holder wallet, comprising:

a first panel;

a second panel, wherein the second panel is opposite to the first panel;

a first elastic band, wherein one end of the first elastic band is fixed to a position of the first panel close to one side, and another end of the first elastic band is fixed to a position of the second panel close to one side;

a second elastic band, wherein one end of the second elastic band is fixed to a position of the first panel close to another side, and another end of the second elastic band is fixed to a position of the second panel close to another side; and a flexible band, wherein one end of the flexible band is fixed at a bottom of the first panel or close to the bottom of the first panel, and another end of the flexible band is fixed at a bottom of the second panel or close to the bottom of the second panel;

the first panel and the second panel are both flexible; the first panel and the second panel are at least partially made of flexible materials; and the first panel, the second panel, the first elastic band, the second elastic band, and the flexible band form the card holder wallet provided with an opening in one side and having an accommodating cavity;

wherein the first panel comprises: a first panel body, a second panel body connected to the first panel body, and a third panel body arranged between the first panel body and the second panel body; the first panel body and the second panel body are both made of flexible materials; the third panel body has flexibility; the third panel body is sheet-like; the second panel body is located on one side of the first panel body close to the accommodating cavity;

one end of the first elastic band, one end of the second elastic band, and one end of the flexible band are all fixed to the first panel body and/or the second panel body; and another end of the first elastic band, another end of the second elastic band, and another end of the flexible band are fixed to the second panel;

wherein the first panel body is fixed to the second panel body through a sewing thread in a sewn manner and/or fixed to the second panel in a bonded manner at a peripheral side of the third panel body;

wherein the first panel body comprises a first buffer layer and a first flexible layer bonded to the first buffer layer; the second panel body comprises a second buffer layer and a second flexible layer bonded to the second buffer layer; the third panel body is located between the first buffer layer and the second buffer layer; the first flexible layer is made of one of leather, a flexible glue material, and a cloth material; the second flexible layer is made of one of leather, a flexible glue material, and a cloth material; the first buffer layer and the second buffer layer are both made of one of paper, foam, and sponge;

a thickness of the third panel body is 0.15 mm to 1 mm; the third panel body is made of one of plastic, metal, and a carbon fiber material.

2. A card holder wallet, comprising:

a first panel;

a second panel, wherein the second panel is opposite to the first panel;

a first elastic band, wherein one end of the first elastic band is fixed to a position of the first panel close to one side, and another end of the first elastic band is fixed to a position of the second panel close to one side;

a second elastic band, wherein one end of the second elastic band is fixed to a position of the first panel close to another side, and another end of the second elastic band is fixed to a position of the second panel close to another side;

and a flexible band, wherein one end of the flexible band is fixed at a bottom of the first panel or close to the bottom of the first panel, and another end of the flexible band is fixed at a bottom of the second panel or close to the bottom of the second panel;

the first panel and the second panel are both flexible; the first panel and the second panel are at least partially made of flexible materials; and the first panel, the second panel, the first elastic band, the second elastic band, and the flexible band form the card holder wallet provided with an opening in one side and having an accommodating cavity, wherein the first panel comprises: a first panel body, a second panel body connected to the first panel body, and a third panel body arranged between the first panel body and the second panel body; the first panel body and the second panel body are both made of flexible materials; the third panel body has flexibility; the third panel body is sheet-like; the second panel body is located on one side of the first panel body close to the accommodating cavity;

one end of the first elastic band, one end of the second elastic band, and one end of the flexible band are all fixed to the first panel body and/or the second panel body; and another end of the first elastic band, another end of the second elastic band, and another end of the flexible band are fixed to the second panel;

wherein the second panel comprises: a fourth panel body, a fifth panel body connected to the fourth panel body, and a sixth panel body arranged between the fourth panel body and the fifth panel body; the fourth panel body and the fifth panel body are both made of flexible materials; the sixth panel body has flexibility; the sixth panel body is sheet-like; the fifth panel body is located on one side of the fourth panel body close to the accommodating cavity; and another end of the first elastic band, another end of the second elastic band, and another end of the flexible band are fixed to the fourth panel body and/or the fifth panel body.

3. The card holder wallet according to claim 2, wherein the fourth panel body is fixed to the fifth panel body through a sewing thread in a sewn manner and/or fixed to the fifth panel body in a bonded manner at a peripheral side of the sixth panel body.

4. The card holder wallet according to claim 2, wherein the fourth panel body comprises a third buffer layer and a third flexible layer bonded to the third buffer layer; the fifth panel body comprises a fourth buffer layer and a fourth flexible layer bonded to the fourth buffer layer; the sixth panel body is located between the third buffer layer and the fourth buffer layer; the third flexible layer is made of one of leather, a flexible glue material, and a cloth material; the fourth flexible layer is made of one of leather, a flexible glue material, and a cloth material; the third buffer layer and the fourth buffer layer are both made of one of paper, foam, and sponge;

a thickness of the sixth panel body is 0.15 mm to 1 mm; and the sixth panel body is made of one of plastic, metal, and a carbon fiber material.

5. The card holder wallet according to claim 2, wherein one end of the first elastic band, one end of the second elastic band, and one end of the flexible band are all arranged between the first panel body and the second panel body, and another end of the first elastic band, another end of the second elastic band, and another end of the flexible band are located on one side of the fifth panel body away from the second panel body;

one end of the first elastic band, one end of the second elastic band, and one end of the flexible band are sewn together with the first panel body and the second panel body through sewing threads; and another end of the first elastic band, another end of the second elastic band, and another end of the flexible band are sewn together with the fourth panel body and the fifth panel body through sewing threads.

6. The card holder wallet according to claim 2, wherein a first decoration edge is arranged at a peripheral side of the first panel; the first decoration edge at least covers a gap between the first panel body and the second panel body;

a second decoration edge is arranged at a peripheral side of the second panel; and the second decoration edge at least covers a gap between the fourth panel body and the fifth panel body.

* * * * *